United States Patent [19]

Noble

[11] 3,955,309

[45] May 11, 1976

[54] STUFFED BENDABLE DOLL

[75] Inventor: Sid Noble, West Orange, N.J.

[73] Assignee: Mego Corporation, New York, N.Y.

[22] Filed: Nov. 18, 1974

[21] Appl. No.: 524,402

[52] U.S. Cl. ..... 46/151; 46/158; 46/162

[51] Int. Cl.[2] ..... A63H 3/04; A63H 3/46

[58] Field of Search ..... 46/151, 158, 162, 163, 46/164

[56] References Cited

UNITED STATES PATENTS

| | | | |
|---|---|---|---|
| 2,209,791 | 7/1940 | Norriss | 46/162 |
| 3,624,691 | 11/1971 | Robson et al. | 46/151 |
| 3,866,350 | 2/1975 | Goldfarb et al. | 46/164 |

*Primary Examiner*—Louis G. Mancene
*Assistant Examiner*—Robert F. Cutting
*Attorney, Agent, or Firm*—Kirschstein, Kirschstein, Ottinger & Frank

[57] ABSTRACT

The stuffed bendable doll has an internal frame which supports the body and limbs of the doll. The internal frame is formed from a material which can be easily bent into a desired shape. Strengthening means within the internal frame gives added support to the frame. A connecting element rotatably secures the head of the doll to the internal frame. The hands and feet of the doll are rotatably mounted on the respective arm and leg support elements of the internal frame and are in communication with the strengthening means within the internal frame. The fabric skin is prevented from separating from the hands and feet when the arms and legs of the doll are bent to prevent the stuffing from escaping from beneath the fabric skin.

11 Claims, 4 Drawing Figures

STUFFED BENDABLE DOLL

BACKGROUND OF THE INVENTION

1. Field of the Invention

The present invention relates to a doll and more particularly to a stuffed bendable doll.

2. Description of the Prior Art

Many doll manufacturers offer bendable dolls of varying types to the public. These dolls are usually made of plastic material.

The most common prior art bendable doll does not have an internal frame. In such a doll the limbs lack the inherent ability to remain in a desired position. Unless they are externally supported they return to their original positions.

In other prior art dolls a wire frame is used to support the limbs in a desired position. In this type of doll due to the constant bending of the doll by a child the wire in the frame soon fails, thereby eliminating the support for the limbs.

In both of these prior art bendable dolls, the head, hands and feet are not moveable.

In other types of prior art dolls, the limbs are formed from a bendable plastic. However, they lack the charm and appearance possessed by stuffed dolls.

It is toward elimination of these problems that the present invention is directed.

SUMMARY OF THE INVENTION

It is an object of the present invention to provide a stuffed bendable doll having a body and limbs which can be bent into desired positions.

Another object of the present invention is to provide an internal frame for a stuffed bendable doll which will not deteriorate through prolonged use.

Still another object of the present invention is to provide an internal frame for a stuffed bendable doll which is of a unitary construction.

Yet another object of the present invention is to provide strengthening means within the internal frame.

A further object of the present invention is to provide a stuffed bendable doll in which the head hands and feet are moveable.

A still further object of the present invention is to provide a stuffed bendable doll in which the stuffing cannot escape from beneath the fabric skin in the area adjacent the moveable hands and feet.

A yet further object of the present invention is to provide a stuffed bendable doll which is of simplified construction and which can be economically manufactured.

Other objects of the present invention will in part be obvious and will in part be pointed out hereinafter.

According to the present invention the foregoing as well as other objects which will become apparent to those having skill in the art are accomplished by a stuffed bendable doll having an internal frame which supports the body and limbs of the doll in varying positions. Strengthening means within the internal frame gives added support to the frame. A connecting element rotatably secures the head of the doll to the internal frame. The hands and feet of the doll are rotatably mounted on the respective arm and leg support elements of the internal frame and are in communication with the strengthening means. The fabric skin is prevented from separating from the hands and feet when the arms and legs of the doll are bent, to prevent the stuffing from escaping from beneath the fabric skin.

The invention accordingly consists in the features of construction, combination of elements and arrangements of parts which will be exemplified in the stuffed bendable doll hereinafter described and of which the scope of application will be indicated in the appended claims.

BRIEF DESCRIPTION OF THE DRAWINGS

For a better understanding of the present invention, reference should be had to the accompanying drawings, wherein like numerals of reference indicate similar parts throughout the several views and wherein.

DESCRIPTION OF THE PREFERRED EMBODIMENT

Figure 1:
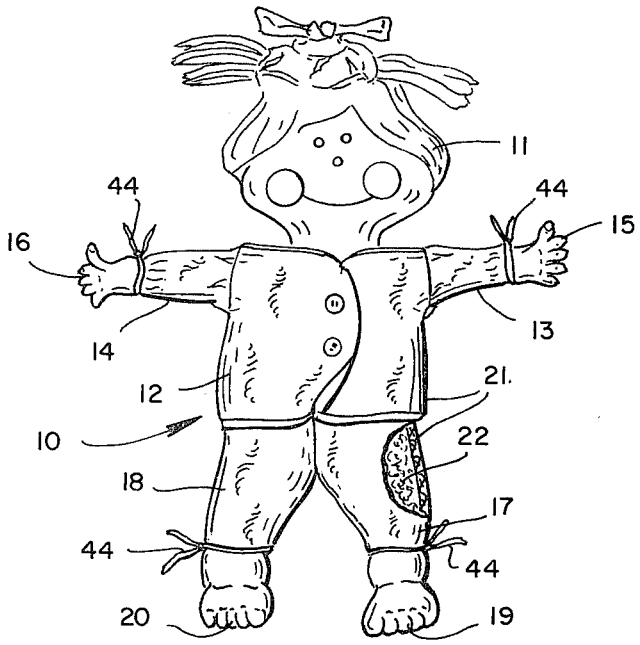
FIG. 1 is a front view of a stuffed bendable doll constructed in accordance with the present invention.

Generally, a stuffed bendable doll in accordance with the present invention is identified in FIG. 1 by the reference numeral 10. The stuffed bendable doll or doll 10 has a head 11 and a body 12. The arms 13 and 14 have hands 15 and 16 respectively at their ends. The legs 17 and 18, having feet 19 and 20 at their ends respectively, depend from the body 12. The doll 10 is given shape by means of an internal frame, not shown in FIG. 1, which will be described hereinafter in further detail. This internal frame of the doll 10 is covered with a fabric skin 21. The fabric skin 21 may be of any material and can be of any fanciful nature to represent clothing on the doll 10. The stuffing 22 beneath the fabric skin 21 gives the doll 10 consistency. The stuffing 22 can be of any soft material and is preferably cotton or urethane.

Figure 2:
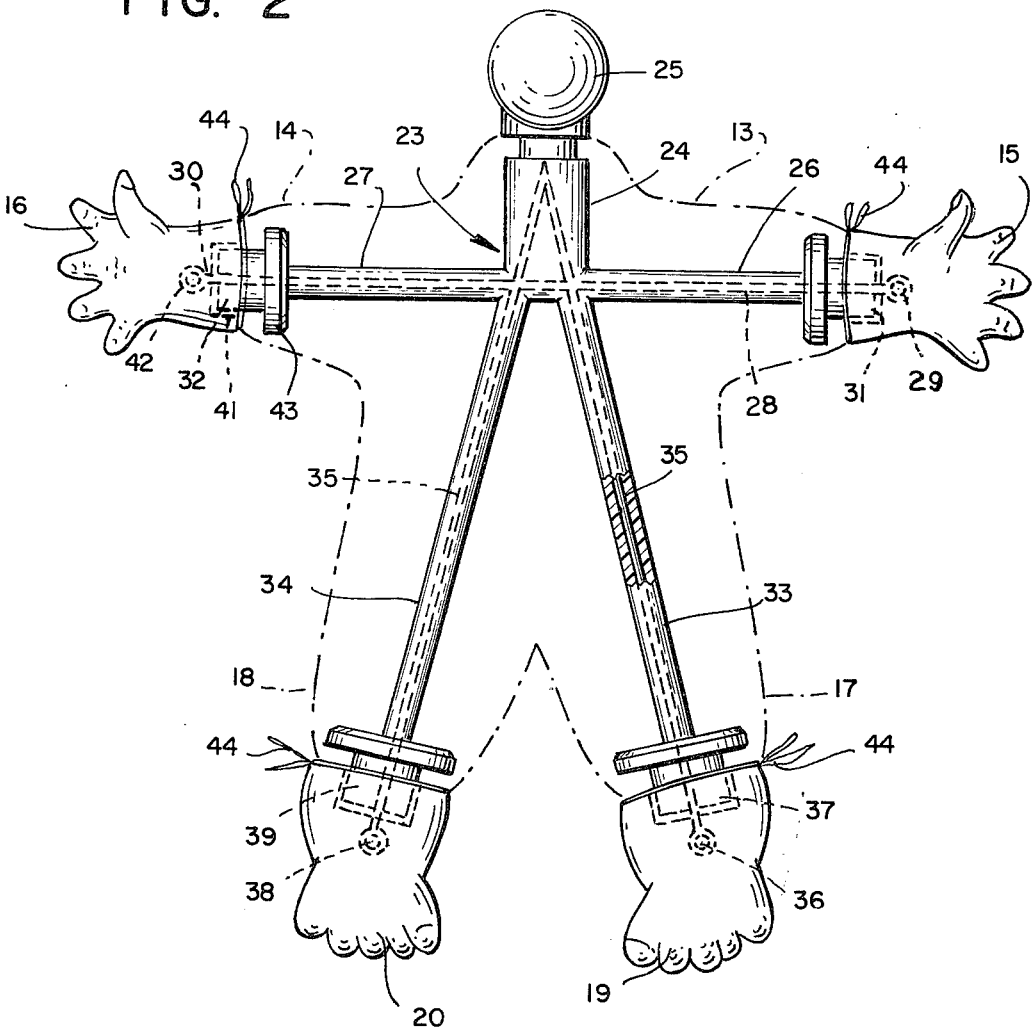
FIG. 2 is an enlarged sectional view of the internal frame, with the head of the doll removed and with the outline of the fabric skin of the doll shown in phantom lines.

The internal frame hereinabove mentioned which gives shape to the doll 10 is shown in FIG. 2 and is identified generally by the reference numeral 23. The internal frame or frame 23 is preferably of a unitary construction for reasons which will become more apparent. The frame may be of any bendable material, however, the use of a polyvinyl chloride material is preferred. The polyvinyl chloride material is easily bendable and will not deteriorate through the constant bending a doll of this nature will be subjected to. In addition the polyvinyl chloride material is easily molded which, for reasons to be hereinafter discussed, is necessary.

The frame 23 can be considered as being composed of several elements. A neck element 24 has connected thereto a connecting element 25 which secures the doll's head 11 to the frame 23 in a manner to be hereinafter described in more detail so that the doll's head 11 may rotate on the frame 23 and may turn relative to the body 12.

The arms 13 and 14 and the legs 17 and 18 are supported internally by their respective support elements of the frame. Extending from the neck element 24 are arm support elements 26 and 27 which support arms 13 and 14 respectively. The arm support elements 26 and 27 are in same plane so that the arms 13 and 14 of the doll 10 extend from the body 12 giving an appearance not unlike that of the arms of the human being when they are extended from the body. Located within the neck element 24 and the arm support elements 26 and 27 is a strengthening member 28. Strengthening member 28, preferably a continuous steel wire, is trapped within the arm support elements 26 and 27. The strengthening member 28 provides additional strength to the arm support elements 26 and 27 so that during prolonged use the arm support elements 26 and 27 will not break due to failure resulting from excessive bending of the arms 13 and 14. For reasons which will hereinafter be more fully discussed strengthening member 28 has end portions 29 and 30 which extend beyond the end 31 of arm support element 26 and the end 32 of arm support element 27 respectively.

The legs of the doll 10 are given internal support by leg support elements 33 and 34 which depend from the neck element 24. The leg support elements 33 and 34 are in the same plane having arm support elements 26 and 27 to give a realstic configuration to the doll 10. Within the leg support elements 33 and 34 and neck element 24 is a second strengthening member 35. The second strengthening member 35 preferably a continuous steel wire has one end 36 extending from the end 37 of the leg support element 33 and its other end 38 extending from the end 39 of the leg support element 34.

As mentioned hereinabove the internal frame 23 is made from a moldable material. The strengthening members 28 and 35 are placed within the frame during the molding process so that the frame 23 has a unitary construction with the strengthening members 28 and 35 trapped therein.

Figure 3:
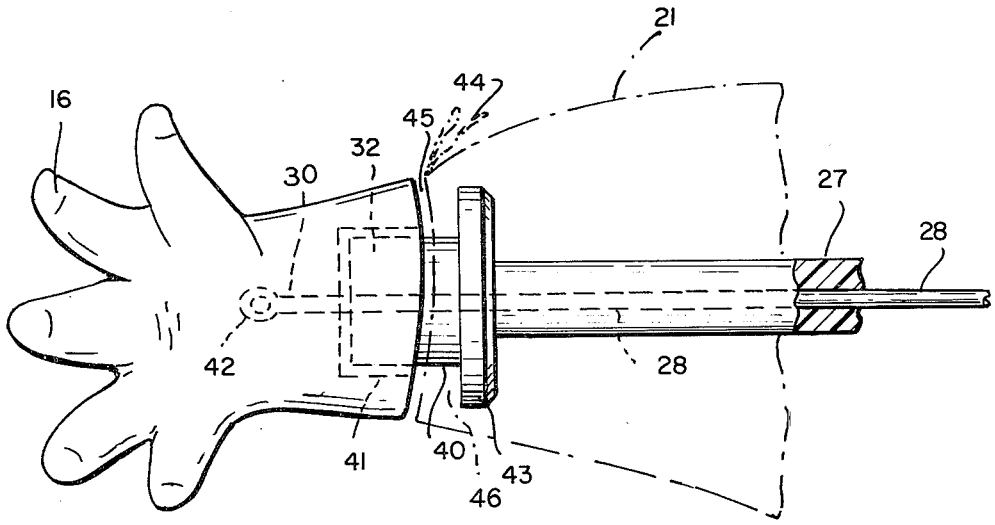
FIG. 3 is an enlarged view of a typical joint with the fabric skin of the doll shown in phantom lines.

While the following discussion will concern itself with the cooperation of hand element 16 which the frame 23 it is to be understood that the cooperation of hand element 15 and foot elements 19 and 20 with the frame 23 will be identical. Referring to FIG. 3, the arm support element 27 is enlarged at its end 32 to create an enlargement 40. The enlargement 40 has a generally cylindrical shape with an outer surface of a constant diameter. The hand 16, as well as the hand 15 and the feet 19 and 20, is formed from a moldable material, preferably a moldable plastic e.g. polyvinyl chloride. The hand 16 is provided with an enlargement receiving portion 41 which is cylindrical in shape and which has a diameter slightly greater than the diameter of the outer surface of the enlargement 40. The enlargement receiving portion 41 extends into the hand 16 a distance less than the length of the enlargement 40 so that, for reasons which will become apparent hereinafter, when the hand 16 is positioned on the enlargement 40, the enlargement is not fully received within the enlargement receiving portion 41. Since the enlargement receiving portion 41 has a diameter larger than the diameter of the outer surface of the enlargement 40, the hand 16 can be rotated on the enlargement 40.

To captively retain the hand 16 on the enlargement 40, the hand 16 is molded onto the end 30 of the first strengthening member 28 which extends beyond the end of the enlargement 40. Preferably the end 30 is formed into a loop 42 about which the hand is molded, which serves to anchor the hand 16 to the end 30 to prevent the hand 16 from being pulled off of the end 30 by a child playing with the doll. The hand 16 is therefore permitted rotational movement on the end of the arm support element 27 and is prevented from being pulled therefrom.

The hand 15 is similarly mounted to the enlargement 31 of the internal frame 23 and secured to the end 29 of the first strengthening member 28. In addition, the feet 19 and 20 are likewise mounted to the enlargements 37 and 38 respectively on the internal frame 23 and securely attached to the ends 36 and 38 respectively of the second strengthening member 35.

The stuffing 22 is prevented from escaping from beneath the fabric skin 21 where the hands and feet join the arms and legs, respectively, of the doll 10. With reference to FIG. 3, a collar 43 is formed on the arm support element 27, and may be integrally formed therewith. The collar 43 has a diameter greater than that of the enlargement 40. The fabric skin 21 has a tie-off string 44 at the end 45 adjacent hand 16. The tie-off string 44 is used to close the end 45 around the enlargement 40 thus preventing the stuffing 22 from escaping from beneath the fabric skin 21. When this is done some of the stuffing 22 is trapped in the area identified by the reference numeral 46 which is formed between the collar 43 and the now closed end 45. When the arm 14 of the doll is bent the collar 43 and the stuffing trapped in area 46 prevent the end 45 from moving away from the hand 16 on the enlarged portion 40. In addition to maintaining the good appearance of the doll, this further prevents the stuffing from escaping.

In a similar fashion the fabric skin 21 is secured to the ends of the arm 13 and the legs 17 and 18 so that when the doll 10 is bent into any configuration the stuffing will not escape from beneath the fabric skin 21.

Figure 4:
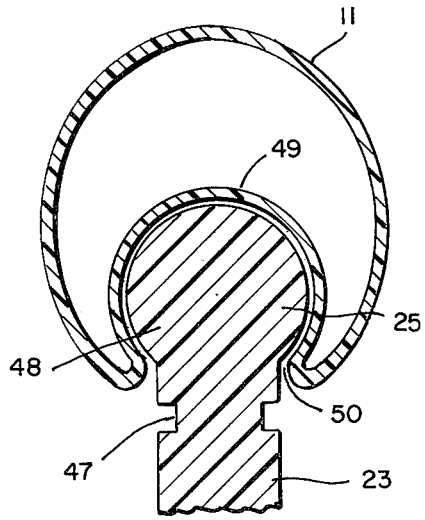
FIG. 4 is an enlarged sectional view of the connecting element and the head of the doll which is secured thereto.

As shown in FIG. 4, the head 11 of the doll 10 is rotatably secured to the frame 23 by means of a ball and socket joint. The connecting element 25 is integrally formed with the frame 23 and consists of a transition element 47 and a ball 48. The diameter of the transition element 47 is less than the ball 48. The head 11 has an integrally formed socket 49 which cooperates with the ball 48 so that the head 11 can rotate on the frame 23, and is formed from a deformable plastic material so that it can be easily forced onto the ball 49. The opening 50 of the socket 49 has a diameter less than the diameter of the ball 48 so that when the head 11 is forced onto the connecting element 25 the head is fixedly secured thereto.

It can be seen from the foregoing detailed description that the objects of the invention, namely to create an improved stuffed bendable doll have been achieved by a stuffed bendable doll having a bendable internal frame supporting the body and limbs of the doll. Strengthening means within the internal frame gives added support to the elements of the frame. The hands and feet of the doll are rotatably mounted on the respective arm and leg support elements of the frame and are in communication with the strengthening means within the frame. The fabric skin is prevented from separating from the hands and feet when the arms and legs of the doll are bent to prevent the stuffing from escaping from beneath the fabric skin.

While in accordance with the patent statutes a preferred embodiment of the present invention has been illustrated and described in detail, it is to be particularly understood that the invention is not limited thereto or thereby.

What is claimed is:

1. A stuffed bendable doll having a head and limbs, said stuffed bendable doll comprising:

a. an internal frame of a bendable material having a neck element with a connecting element to which said head is rotatably secured and a pair of arm support elements and a pair of leg support elements extending from said neck element providing internal support for said limbs of said doll, each of said pair of arm support elements and each of said pair of leg support elements having an end;

b. a pair of hands;

c. a pair of feet;

d. means for rotatably mounting said pair of hands to said ends of said pair of arm support elements so that each of said ends of said pair of arm support elements has one of said pair of hands rotatably mounted thereon;

e. means for rotatably mounting said pair of feet to said ends of said pair of leg support elements so that each of said ends of said pair of leg support elements has one of said pair of feet rotatably mounted thereon;

f. strengthening means within said internal frame to prevent failure of said internal frame, portions of said strengthening means extending from each of said ends of said pair of arm support elements and said pair of leg support elements, said pair of hands and said pair of feet being secured to said portions to retain said pair of hands on said pair of arm support elements and said pair of feet on said pair of leg support elements;

g. a fabric skin adaped to cover said internal frame; and h. stuffing material beneath said fabric skin to give said doll consistency.

2. A stuffed bendable doll in accordance with claim 1 wherein said strengthening means comprises:

a. a first strengthening member within said arm support elements; and b. a second strengthening member within said leg support elements.

3. A stuffed bendable doll in accordance with claim 2 wherein said first and second strengthening members are each a continuous wire.

4. A stuffed bendable doll in accordance with claim 2 wherein said internal frame is formed from a moldable plastic and said strengthening means are molded within said frame.

5. A stuffed bendable doll in accordance with claim 1 further comprising means adjacent said pairs of hands and feet to prevent said stuffing from escaping from beneath said fabric skin.

6. A stuffed bendable doll in accordance with claim 5 wherein said preventive means comprises:

a. a collar adjacent said end on each of said pair of arm support elements and each of said pair of leg support elements, each of said collars being spaced from each of said pair of hands and each of said pair of feet and being covered by said fabric skin; and b. closing means on said fabric skin adjacent each of said hands and each of said feet to close said fabric skin on said pair of arm support elements and said pair of leg support elements between said collars and said pair of hands and said pair of feet to prevent said fabric skin from moving on said pair of arm support elements and said pair of leg support elements when a child manipulates said limbs of said doll and to prevent said stuffing from escaping from beneath said fabric skin.

7. A stuffed bendable doll in accordance with claim 6 wherein said closing means includes a tie-off string.

8. A stuffed bendable doll in accordance with claim 1 wherein said internal frame is formed from polyvinyl chloride.

9. A stuffed bendable doll in accordance with claim 1 wherein said stuffing is cotton.

10. A stuffed bendable doll in accordance with claim 1 wherein said stuffing is urethane.

11. A stuffed bendable doll in accordance with claim 1 wherein said means for rotatably mounting said pair of hands to said pair of arm support elements comprises an enlargement on each of said pair of arm support elements at said ends, and an enlargement receiving portion in each of said pair of hands adapted to rotatably receive said enlargements at said ends of said pair of arm support elements and said means for rotatably mounting said feet to said pair of leg support elements comprises an enlargement on each of said pair of leg support elements at said ends, and an enlargement receiving portion of each of said pair of feet adapted to rotatably receive said enlargement at said ends of said pair of leg support elements.

* * * * *

UNITED STATES PATENT OFFICE

CERTIFICATE OF CORRECTION

PATENT NO. : 3955309

DATED : May 11, 1976

INVENTOR(S) : Sid Noble

It is certified that error appears in the above-identified patent and that said Letters Patent are hereby corrected as shown below:

Cancel Figure appearing on page 1, substitute therefor FIG. 1 as appears below:

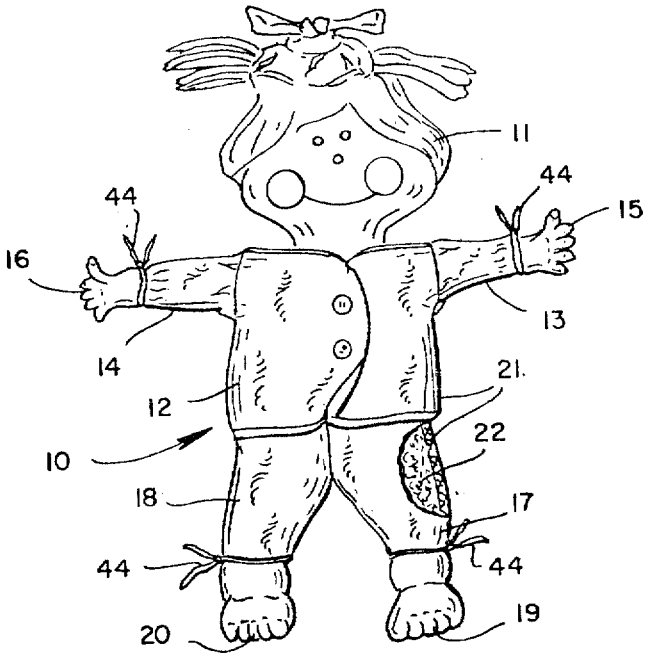

Signed and Sealed this

Seventh Day of September 1976

[SEAL]

*Attest:*

RUTH C. MASON
*Attesting Officer*

C. MARSHALL DANN
*Commissioner of Patents and Trademarks*